United States Patent [19]

Deutsch et al.

[11] 4,052,924

[45] Oct. 11, 1977

[54] INTERVAL REPEAT GENERATOR FOR KEYBOARD MUSICAL INSTRUMENT

[75] Inventors: Ralph Deutsch; Leslie J. Deutsch, both of Sherman Oaks, Calif.

[73] Assignee: Kawai Musical Instrument Mfg. Co. Ltd., Hamamatsu, Japan

[21] Appl. No.: 712,744

[22] Filed: Aug. 9, 1976

[51] Int. Cl.[2] ..... G10H 1/02

[52] U.S. Cl. ..... 84/1.24; 84/1.03

[58] Field of Search ..... 84/1.01, 1.03, 1.24, 84/1.25, 1.26, DIG. 2, DIG. 22

[56] References Cited

U.S. PATENT DOCUMENTS

| | | | |
|---|---|---|---|
| 3,598,892 | 8/1971 | Yamashita | 84/1.01 |
| 3,842,184 | 10/1974 | Kniepkamp | 84/1.01 |
| 3,910,150 | 10/1975 | Deutsch et al. | 84/1.03 |
| 3,954,038 | 5/1970 | Adams | 84/1.01 |

*Primary Examiner*—Robert K. Schaefer
*Assistant Examiner*—Vit W. Miska
*Attorney, Agent, or Firm*—Christie, Parker & Hale

[57] ABSTRACT

A keyboard instrument having key-operated switches connected in groups corresponding to musical octaves. The groups of keys are pulsed sequentially to provide successive patterns of pulses on parallel time-shared output lines, each group of keys having its own time slot by which the octave of the notes is identified. The pattern of pulses during each time slot identifies the notes within the octave that are to be generated. A repeat signal generator periodically modifies or interrupts the pattern of pulses during the associated time slot. The pattern of pulses may be in effect interrupted as to the keyed note by shifting the pattern of pulses to an adjacent time slot corresponding to another octave for repetitively generating the same note alternately in two octaves.

9 Claims, 3 Drawing Figures

INTERVAL REPEAT GENERATOR FOR KEYBOARD MUSICAL INSTRUMENT

FIELD OF THE INVENTION

This invention relates to electronic keyboard musical instruments, and more particularly, to an interval repeat generator by which a keyed note is repeated continuously at control frequency or repeated alternately with a second note at a predetermined musical interval, such as an octave, with respect to the keyed note.

BACKGROUND OF THE INVENTION

In the design of electronic keyboard musical instruments, one feature which has been found desirable is to be able to generate a note repetitively by holding down the key corresponding to that note. The repetitive frequency may be independently controlled. This feature is sometimes expanded to include the playing of a second note at a musical interval, such as a third or an octave, above or below the keyed note at the repeat frequency. The repetitive pattern of notes continues at the controlled repetition frequency as long as the associated key is depressed. One such instrument is described in U.S. Pat. No. 3,910,150.

In copending application Ser. No. 619,615, filed Oct. 6, 1975, entitled "Keyboard Switch Detect and Assignor" there is described a keyboard switching arrangement for scanning keyboard-operated switching and generating digital information as to the status of the switches for control of a plurality of tone generators in a polyphonic tone synthesizer, for example. The present invention is directed to an improvement in the keyboard switch detect and assignor circuit which permits incorporation of the above-described interval repeat function. The circuit of the present invention thus provides an arrangement by which actuation of a single key on the keyboard produces control information by which the keyed note may be iterated at any desired repetition frequency under the control of a variable clock. Alternatively, a second note at an octave above or an octave below the keyed note, or at some other interval in relation to the keyed note, may be generated alternately with the keyed note at the clock rate.

SUMMARY OF THE INVENTION

In brief, the present invention is incorporated in a keyboard switching and assigning circuit in which key-operated switches are arranged in groups, each key-operated switch in a group corresponding to one note of the standard 12 notes in an octave. Each group of switches is pulsed repetitively in time sequence with the other groups, the switches of each group selectively connecting the pulses to a plurality of output lines to form a parallel pattern of output pulses corresponding to the pattern of selected keys in the associated octave. By sequentially pulsing the groups of switches, the output lines are time shared in sequence with the other groups, each group having an associated time slot. A repititive pattern of notes is generated in response to operation of one or more keys by providing a clock source having the desired repeat frequency. Switching means synchronized with the clock source periodically interrupts the generation of the pattern of pulses on the output lines during the corresponding time slot to signal the termination of the note just as though the key-operated switch had been released. Coincidently with the interruption of one time slot, the same pattern of pulses may be shifted to another time to signal the same pattern of notes in a different octave, even though the corresponding key-operated switches have not been activated in that octave. The time slot shift may be accomplished by inroducing a delay in the output pulses on the parallel output lines, or may be accomplished by shifting the time at which the switches in a particular group of switches are pulsed.

DESCRIPTION OF THE DRAWINGS

For a better understanding of the invention reference should be made to the accompanying drawings, wherein.

DETAILED DESCRIPTION

The present invention is described below as an improvement on the keyboard switch detect and assignor circuit described in detail in the above-identified application, which is incorporated herein by reference. Those portions of the circuit as described herein which are identical to portions of the circuit described in the above-identified application are indicated by the same reference numbers throughout the present application.

Figure 1:
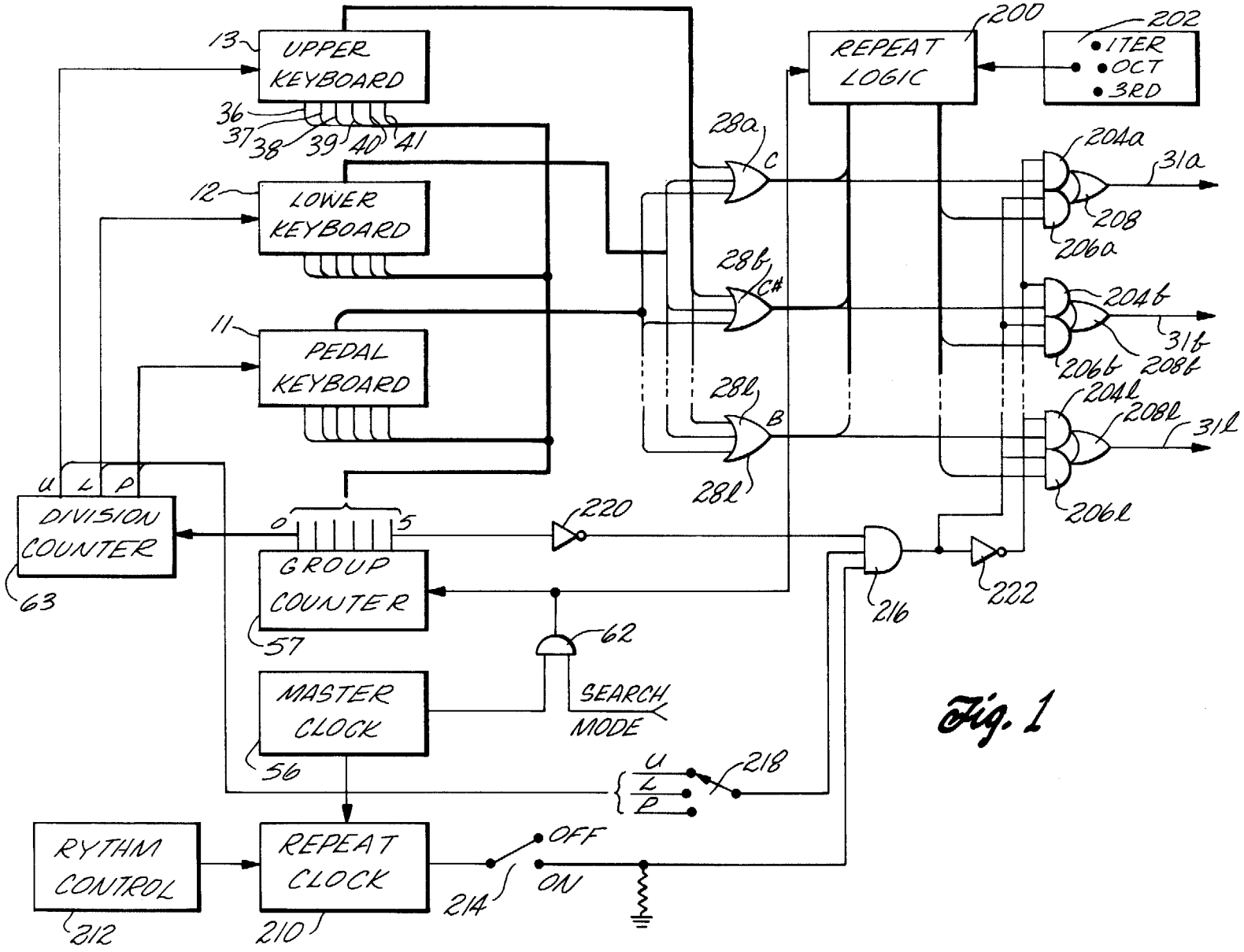
FIG. 1 is a schematic block diagram of one embodiment of the present invention.

Referring to FIG. 1, the keyboard switch detect and assignor circuit is shown, by way of example, for an electronic musical instrument having three separate keyboards, a pedal keyboard 11, a lower keyboard 12, and an upper keyboard 13. Each keyboard, in the manner of a conventional electronic organ, includes a standard keyboard of twelve notes to an octave with typically six octaves to a keyboard, although the number of octaves may vary according to the size and arrangement of the instrument. As described in detail in the above-identified patent application, each key operates a normally open switch that is closed when the associated key is depressed. The key-operated switches are arranged in groups, each group corresponding to the twelve notes of an octave.

Scanning of the groups of key is done in synchronism with a master clock 56. The clock pulses are applied to a Group counter 57 through an AND gate 62 whenever the keyboard switch detect and assignor circuit is in the search mode. The Group counter 57 advances through six output states, corresponding to the number of key-operated switch groups in each of the keyboards. The six output lines from the Group counter 57, indicated at 36, 37, 38, 39, 40, and 41, successively pulse each of the groups of key-operated switches as the Group counter is advanced by pulses from the clock source 56. Each of the keyboards is in turn activated in sequence by the output of a Division counter 63 which is advanced by one with each complete cycle of the Group counter 57.

There are 12 output lines from each keyboard, corresponding to the twelve notes in each octave. The 12 key-operated switches of each group connect the input pulse on the associated one of th six input lines from the Group counter to a corresponding one of the 12 output lines. The corresponding output lines from each keyboard are combined by 12 OR gates, indicated at **28*a* through 28*l*. Thus an output pulse on any one of the output lines from the OR gates 28** indicates that a key in any one of the groups and any one of the keyboards corresponding to a particular note in an octave has been depressed. The particular group and the particular keyboard is identified by the time slot which the pulse on the associated output line occurs as the groups of key-operated switches and the keyboards are scanned in sequence.

As thus far described, the circuit is identical to that described in more detail in the above-identified copending application. To implement the Interval Repeat function of the present invention, in the arrangement of FIG. 1, the pulse pattern on the output lines from the OR gates 28a through 28l is modified in a predetermined manner before being coupled to a corresponding group of 12 output lines 31a through 31l. The pattern change is controlled by a Repeat Logic circuit 200 which is described below in more detail in connection with FIG. 2. The twelve output lines from the respective OR gates 28a through 28l are connected to the input of the Repeat Logic circuit 200 which modifies the pattern of pulses on a corresponding number of output lines according to at least three different modes of operation of the Interval Repeat function, as set by a switch 202. The three modes, by way of example, include an ITERative mode in which the keyed note is repeated at the desired rate. The second mode is the OCTave mode in which the keyed note is sounded alternately with the same note at an octave interval above the keyed note. The 3RD mode is one in which the keyed note is sounded alternately with a note which is a third of an octave above the keyed note.

The pattern of pulses at the output of the OR gates 28a through 28l is directly coupled to the associated output lines 31a through 31l through associated AND gates 204a through 204l, while the modified pattern of pulses from the Repeat Logic circuit 200 is coupled to the output lines 31a through 31l by means of AND gates 206a through 206l. The outputs of the AND gates 204 and 206 are combined by logical OR gates, the 12 logical OR gates being indicated at 208a through 208l.

To control the interval rate, the AND gates 204 and 206 are switched periodically in response to the output of a Repeat Clock generator 210. The output of the Repeat Clock generator is preferably a squarewave in which the crossovers between two output levels occur at time intervals controlled by the clock frequency. The timing of the crossover points of the Repeat Clock output may be modified by a rhythm control circuit 212 which controls both the frequency of the Repeat Clock generator and the symmetry of the waveform.

The output from the Repeat Clock generator is connected through an On/Off switch 214 which is turned on when the Interval Repeat function is initiated. The On/Off switch 214 couples the output of the Repeat Clock generator 210 to one input of an AND gate 216. A second input of the AND gate 216 is connected to one of the three outputs of the Division counter 63 by a switch 218. Setting of the switch 218 determines which of the three keyboards is assigned to the Interval Repeat function. While the switch 218 is shown as selecting one of the three keyboards, the switch may be arranged to select any two or all three of the keyboards, if desired. A third input to the AND gate 216 is derived from the output line 41 of the Group counter 57, corresponding to the highest octave group in the keyboard. An inverter 220 insures that the output of the AND gate 216 can be true only for the five lower octaves of each keyboard. This condition is required for the OCTave mode and the 3RD mode since these modes contemplate generating a note at an interval above the keyed note, which higher note may not exist for keyed notes in the highest octave of the keyboard.

The output of the AND gate 216 is connected directly to the second input of each of the AND gates 206a through 206l. The output of the AND gate 216 is also connected through an inverter 222 to the second input of each of the AND gates 204a through 204l. Thus as the output level of the AND gate 216 is switched by the Repeat Clock generator 210, the two groups of AND gates 204 and 206 are activated alternately at the repetition frequency of the Repeat clock. It should be noted that when the Interval Repeat switch is Off, the output of the inverter 222 is true and thus the AND gates 204a through 204l operate to directly connect the output of the OR gates 28a through 28l to the respective output lines 31a through 31l. Thus the keyboard switch detect and assignor circuit functions in the normal manner described in the above-identified copending application when the Interval Repeat function is not operating.

Figure 2:
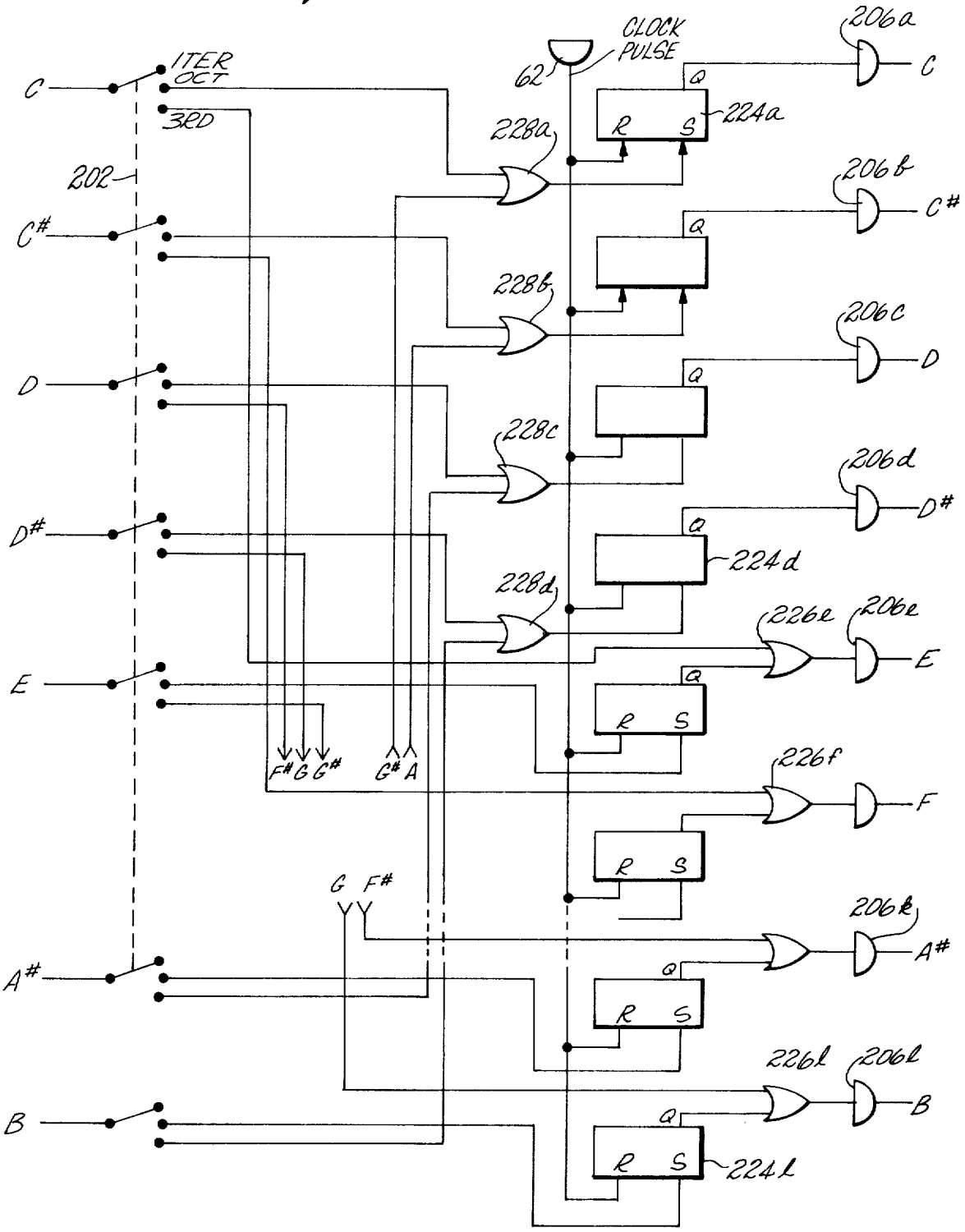
FIG. 2 is a logical block diagram of the repeat logic circuit of FIG. 1.

Referring to FIG. 2, the Repeat Logic circuit 200 is shown in detail. The twelve input lines from the OR gates 28a through 28l are connected by the switch 202 to one of three corresponding output lines depending upon the setting of the switch. When the switch is in the ITERative position the Repeat Logic circuit is disconnected from the output so that no modified pattern is applied to the AND gates 206a through 206l. Thus the pulses produced by the keyed notes are directly coupled to the output lines through the AND gates 204a through 204l during repetitive intervals controlled by the Repeat Clock generator 210.

With the switch 202 set for the OCTave mode, each of the input lines is connected to one input of an associated flip-flop, indicated at 224a through 224l. The flip-flop is set in response to a pulse on the associated input line resulting from the corresponding key being depressed in any one of the octaves of any one of the keyboards. Each of the flip-flops 224a through 224l is reset by a clock pulse from the output of the AND gate 62. Thus each flip-flop acts as a one clock pulse time delay circuit. The output of each of the twelve flip-flops is connected to the respective AND gates 206a through 206l. Thus a pattern of pulses is applied to the AND gates 206l to the output lines which is identical to the pattern of pulses appearing on the input lines, but delayed by one clock pulse time. Thus the output pulses occupy a time slot corresponding to the next higher octave than the keyed notes. The effect is the same as though the corresponding keys an octave apart were played alternately.

With the switch 202 set for the 3RD mode, the input lines for the notes C through G are connected to the input of the AND gates 206 associated with the notes E through B, which notes are at a musical internal of the 3rd higher than the keyed note. OR gates 226e through 226l are provided to combine the signals from the input lines with the signals from the delay flip-flops 224.

Since for the notes G# through B, the 3RD interval corresponds to notes C through D# respectively in the next higher group, these input lines are connected by the switch 202 in the 3RD mode to the delay flip-flops 224a through 224d, respectively, through OR gates 228a through 228d. Thus an input pulse for the note B is coupled through the logical OR circuit 228d to the delay flip-flop 224d, the output of which is connected to the output line corresponding to the note D#, Similarly the A# input is connected through the switch 202 to the input of the delay flip-flop 224c whose output is connected to the output line corresponding to the note E.

To summarize the operation of the circuit of FIGS. 1 and 2, when the Interval Repeat function is on, the pattern of pulses produced by the keyed notes on all the keyboards are directly coupled at their proper time slots through to the output lines 31*a* through 31*l* in the normal manner. For those keyed notes in the keyboard selected for operation of the Interval Repeat function, the pattern of pulses directly coupled to the output lines is periodically interrupted and in addition may be coupled in modified form to the output lines to generate a second note or notes during alternate time intervals controlled by the Repeat Clock generator 210. As described in the above-identified copending application, the keyboard switches affect an assignor circuit only when a change takes place during a given time slot, indicating that the status of the associated key has changed. Thus when the normal pulse sequence coupled through the gates 204*a* through 204*l* is interrupted by the switching off of the gates by the Repeat Clock generator 210, the assignor circuit responds as though the keyed note has been released. Also when the AND gates 206*a* through 206*l* provide a pattern of pulses in a different time slot, the assignor circuit responds as though the corresponding note in a different octave had been keyed. Therefore as long as a key is depressed in a keyboard selected for the Interval Repeat function, the assignor circuit will receive information in the form of time pulses at the output lines 31*a* through 31*l* which cause it to reassign each keyed note alternately with a second note just as though two keys had been alternately depressed and released.

Figure 3:
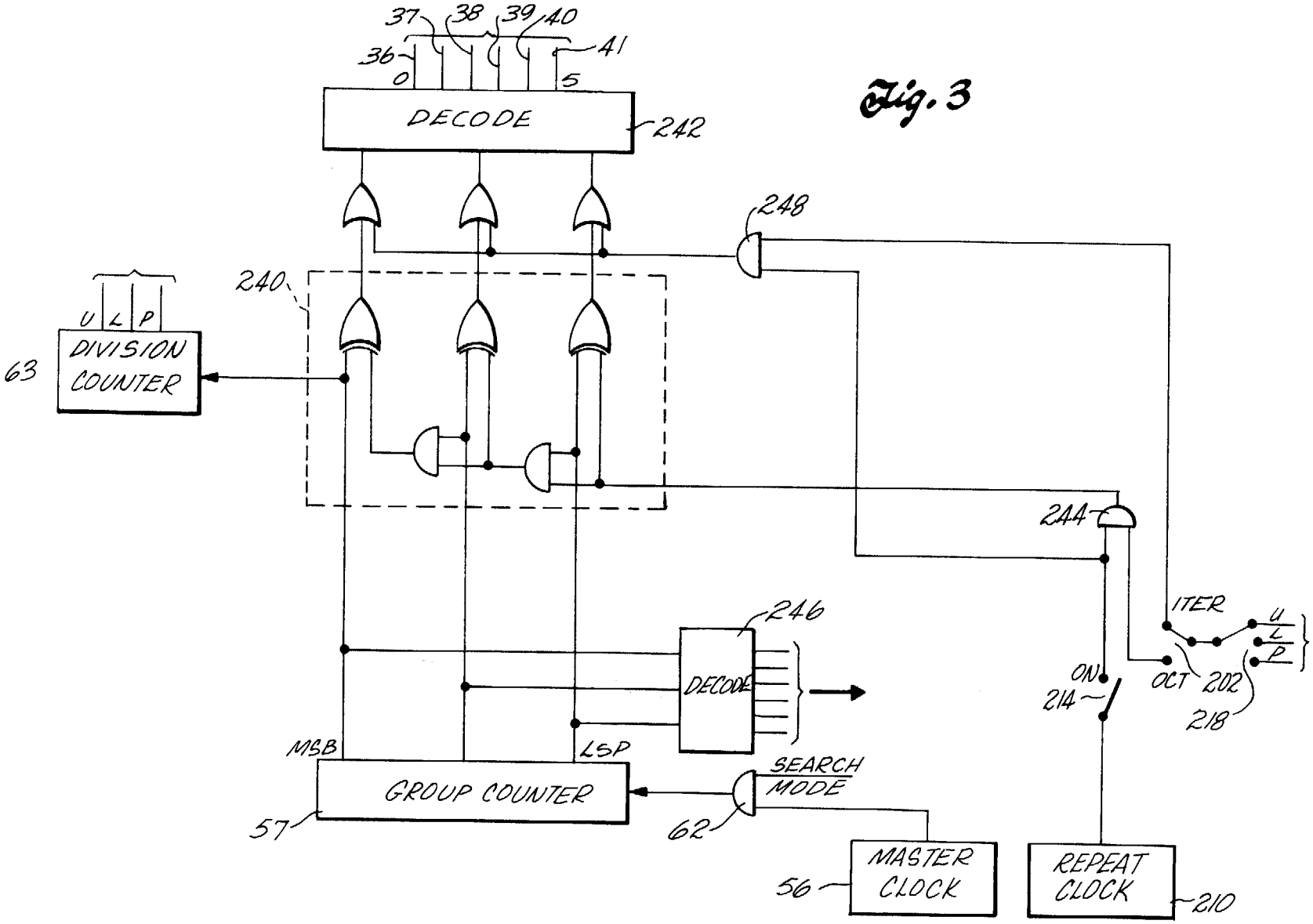
FIG. 3 is a schematic block diagram of an alternative embodiment of the present invention.

In the embodiment described above, the alternate note is always at a higher pitch than the keyed note since the groups of keys are scanned going from the lowest octave to the higher octaves of each keyboard, and therefore the delay introduced by the delay flip-flops corresponds to the next higher pitch time slot. An alternative embodiment is shown in FIG. 3 which permits the alternate note to be sounded at an interval below the keyed note. This is accomplished by incrementing the effective count condition of the Group counter 57 by one during a given time slot. A pulse on the output resulting from the depressing of a particular key thereby occurs in a time slot associated with the next lower octave. For example, if a key is depressed in a group of keys associated with the output line 37 from the Group counter 57, the assignor circuit, as described in the above-identified application, recognizes this fact because the output on the pulse on the associated one of the output lines 31*a* through 31*l* occurs in the corresponding time slot. However, if the Group counter should pulse the output line 37 at the time it would normally be pulsing the line 36, the resulting output pulse on the output lines 31*a* through 31*l* would appear to be in the time slot normally associated with the group of keys in the octave below the key that is depressed. By shifting the time slot in this manner, the assignor circuit interprets the resulting output signal as being associated with a different octave than that of the depressed key.

This arrangement is implemented, as shown in FIG. 3, by coupling the binary output from the Group counter 57 through a logic circuit indicated generally at 240 which increments the binary count condition by one. The logic circuit includes three Exclusive OR gates 241 and a pair of AND gates 243 connected as shown. The incremented binary count condition is then applied to a binary decode circuit 242 which converts the binary input to a one-out-of-six output, the six output lines corresponding to the lines 36, 37, 38, 39, 40 and 41 heretofore described. While the three input lines to the decode circuit 242 are theoretically capable of generating eight different states, only six of those states are valid combinations.

The increment-by-one logic circuit 240 is activated by the output of an AND gate 244 which senses the level of the output from the Repeat Clock generator 210 through the switch 214. It also senses that the Division counter 63 has activated the keyboard selected by the switch 218 and that the OCTave mode has been selected by the switch 202. Thus the increment-by-one logic circuit 240 is activated during alternate half cycles of the squarewave output of the Repeat Clock generator 210. During the intermediate half cycles of the Repeat Clock output, the output of the AND gate 244 turns off the increment-by-one logic so that the binary count condition of the counter 57 is applied in unmodified form to the decode circuit 242.

The effect of the increment-by-one circuit 240 is to shift the output of the decoder 242 by one during a given output pulse from the master clock 56. Thus if the binary count condition of the Group counter is 000, which normally would activate the output line 36 from the decode circuit 242, with the increment-by-one logic 240 activated, the decode circuit 242 activates line 37 rather than line 36 so that the key depressed in the second octave produces an output pulse from the line 37 in a time slot normally assigned to the group of key-operated switches associated with line 36 from the Group counter. It should be noted, however, that the actual count condition of the Group counter 57 must still be available to the assignor circuit for transfer to the assignment memory in the manner described in the above-identified application. To this end, the group counter binary output is applied to a second decode circuit 246, the output of which is available to the assignor circuit during the assign mode.

With the switch 202 set to the ITERative mode, the switch connects the appropriate output of the Division counter 63 to one input of an AND circuit 248 together with the output signal from the Repeat Clock generator 210. The output of the AND circuit is applied to each of the inputs of the decode circuit 242 to force a binary 111 to the output of the decode circuit 242 during alternate half cycles of the repeat clock signal. Since this is a forbidden combination of the decode circuit 242, no output is generated on any of the six output lines from the decode circuit. As a result, no signal is generated on the output lines 31*a* through 31*l*, producing the same effect as though the depressed key had been released. Thus even though the key remains depressed, the effect is the same as though the key were repeatedly depressed and released at the repetition frequency of the Repeat Clock generator 210.

From the above description it will be appreciated that a digital control has been provided for generating the interval repeat function in either an ITERative mode, an OCTave repeat mode, or other note interval mode. The circuit permits notes to be generated at intervals which span more than one octave by transferring key switch information into different time slots in a system where the octaves are scanned serially.

What is claimed is:

1. In a polyphonic tone synthesizer in which individual notes are generated in response to pressing selected keys, the keys being arranged in groups corresponding to octaves and the groups being arranged in divisions corresponding to separate keyboards, the groups of keys in the several divisions being repetitively pulsed in time sequence and the status of all the keys in a group being read out in the form of a parallel pattern of output pulses coincident with the sequential pulsing of each of said groups, apparatus for generating notes in a repetitive pattern in response to operation of a single key in a selected keyboard, comprising: a repeat signal generator for generating a repeat clock signal having a repetitive rate that is different than the rate at which any particular group is repetitively pulsed, and switching means operated by said repeat signal generator for periodically interrupting said sequence of parallel patterns of output pulses during the normal time period for the associated group of keys.

2. Apparatus of claim 1 wherein said switching means includes means for interrupting said parallel pattern from groups of keys associated with only one of the keyboards.

3. Apparatus of claim 1 further including means synchronized with said repeat clock signal for shifting the time period of the interrupted pattern of pulses by a time interval corresponding to the sequence time between pulsing of successive groups of keys.

4. Apparatus of claim 3 wherein said means for shifting includes means for shifting the time a selected group of keys is pulsed in said sequence.

5. Apparatus of claim 3 wherein said means for shifting includes means for delaying the pattern of output pulses of a particular group of keys.

6. In a keyboard musical instrument in which key-operated switches are arranged in groups, each key-operated switch in a group corresponding to one note of the notes in an octave, each group of switches being pulsed repetitively in time sequence with the other groups, and the switches of each group selectively connecting the input pulses to a plurality of output lines to form a parallel pattern of output pulses corresponding to the pattern of selected keys in the associated octave during an associated time slot, apparatus for generating a repetitive pattern of musical notes in response to operation of single key, comprising: a repeat signal generator having a frequency corresponding to the desired frequency of the repetitive pattern of notes, and means synchronized with the repeat signal generating for periodically interrupting the generation of said pattern of pulses on the output lines.

7. Apparatus of claim 6 wherein said means for periodically interrupting the generation of pulses on the output lines includes means interrupting the pulsing of a group of key-operated switches during the normal sequential time slot.

8. Apparatus of claim 7 further including means synchronized with the repeat signal generator for periodically pulsing the group of key-operated switches during a different time slot.

9. Apparatus of claim 7 further including means synchronized with the repeat signal generator for periodically delaying the output pulses from a group of key-operated switches to a different time slot.

* * * * *